US009435234B2

(12) United States Patent
Yang

(10) Patent No.: US 9,435,234 B2
(45) Date of Patent: Sep. 6, 2016

(54) COMBINED ROCKER ARM APPARATUS FOR ACTUATING AUXILIARY VALVE OF ENGINE

(75) Inventor: Zhou Yang, Oak Ridge, NC (US)

(73) Assignee: Shanghai Universoon Autoparts Co., Ltd., Shanghai (CN)

( * ) Notice: Subject to any disclaimer, the term of this patent is extended or adjusted under 35 U.S.C. 154(b) by 292 days.

(21) Appl. No.: 13/995,443

(22) PCT Filed: May 3, 2011

(86) PCT No.: PCT/CN2011/000775
§ 371 (c)(1),
(2), (4) Date: Oct. 3, 2013

(87) PCT Pub. No.: WO2012/083574
PCT Pub. Date: Jun. 28, 2012

(65) Prior Publication Data

US 2014/0020654 A1 Jan. 23, 2014

(30) Foreign Application Priority Data

Dec. 21, 2010 (CN) ..... 2010 1 0604203

(51) Int. Cl.
*F01L 13/06* (2006.01)
*F01L 1/18* (2006.01)
(Continued)

(52) U.S. Cl.
CPC ..... *F01L 13/065* (2013.01); *F01L 1/18* (2013.01); *F01L 1/181* (2013.01); *F01L 1/182* (2013.01); *F01L 1/20* (2013.01); *F01L 1/267* (2013.01); *F01L 1/08* (2013.01); *F01L 2105/00* (2013.01)

(58) Field of Classification Search
CPC ..... F01L 2105/00; F01L 1/267; F01L 1/181; F01L 1/185; F01L 1/18; F01L 2001/186; F01L 13/06
USPC ..... 123/90.1–90.6, 323, 324, 347
See application file for complete search history.

(56) References Cited

U.S. PATENT DOCUMENTS 3,220,392 A 11/1965 Cummins
5,148,783 A * 9/1992 Shinkai ..... F01L 1/267 123/90.16

(Continued)

FOREIGN PATENT DOCUMENTS

CN 1077209 C 1/2002
CN 1985072 A 6/2007
CN 100427740 C 10/2008

OTHER PUBLICATIONS

ISR for application No. PCT/CN2011/000775, mailing date Sep. 1, 2011, pp. 6.

*Primary Examiner* — Lindsay Low
*Assistant Examiner* — Long T Tran
(74) *Attorney, Agent, or Firm* — RuyakCherian LLP

(57) ABSTRACT

A combined rocker arm apparatus for actuating auxiliary valve of engine, comprises an auxiliary actuator, a main rocker arm and a secondary rocker arm. The auxiliary actuator comprises an auxiliary rocker arm and an auxiliary cam. The auxiliary rocker arm and the main rocker arm are mounted on the rocker arm shaft in parallel. The auxiliary rocker arm is connected to the auxiliary cam at one end and adjacent to the secondary rocker arm at the other end. The auxiliary rocker arm includes a drive mechanism which provided with a piston. In the non-operation mode of the drive mechanism, the piston is drawn back, then the auxiliary rocker arm is disconnected with the secondary rocker arm; in the operation mode of the drive mechanism, the piston is pushed out, then the auxiliary rocker arm is connected with the secondary rocker arm.

12 Claims, 3 Drawing Sheets

(51) Int. Cl.

| | |
|---|---|
| ***F01L 1/20*** | (2006.01) |
| ***F01L 1/26*** | (2006.01) |
| *F01L 1/08* | (2006.01) |

(56) References Cited

U.S. PATENT DOCUMENTS 5,809,952 A * 9/1998 Ono ..... F01L 1/181 123/182.1
6,032,624 A * 3/2000 Tsuruta ..... F01L 1/267 123/90.16
6,135,076 A * 10/2000 Benlloch Martinez ..... F01L 13/0047 123/90.16
6,311,659 B1 * 11/2001 Pierik ..... F01L 1/30 123/90.15
6,467,443 B1 * 10/2002 Tsuruta ..... F01L 1/267 123/90.12
6,588,384 B2 * 7/2003 Yapici ..... 123/78 F
6,588,387 B2 * 7/2003 Cecur ..... F01L 1/185 123/90.16
6,968,819 B2 * 11/2005 Fujii ..... F01L 13/0063 123/90.16
7,146,945 B2 * 12/2006 Persson ..... F01L 1/181 123/90.15
7,392,772 B2 * 7/2008 Janak ..... F01L 1/181 123/90.12
7,673,602 B2 * 3/2010 Masegi ..... F01L 13/0021 123/90.16
2006/0207532 A1 * 9/2006 Fujita ..... F01L 13/0026 123/90.16
2007/0204826 A1 * 9/2007 Diggs ..... F01L 1/181 123/90.39

* cited by examiner

COMBINED ROCKER ARM APPARATUS FOR ACTUATING AUXILIARY VALVE OF ENGINE

CROSS-REFERENCE TO RELATED APPLICATIONS

The present application is a national filing in the U.S. Patent & Trademark Office of International Patent Application PCT/CN2011/000775 filed May 3, 2011. and claims priority of Chinese Patent Application NO. 201010604203.3 filed Dec. 21, 2010.

FIELD OF THE INVENTION

The present application relates to the mechanical field, specifically to the valve actuation technology for vehicle engines, particularly to a combined rocker arm device for an auxiliary engine valve event.

BACKGROUND OF THE INVENTION

In the prior art, the method of conventional valve actuation for a vehicle engine is well known and its application has more than one hundred years of history. However, due to the additional requirements on engine emission and engine braking, more and more engines need to produce an auxiliary engine valve event, such as an exhaust gas recirculation event or an engine braking event, in addition to the normal engine valve event. The engine brake has gradually become the must-have device for the heavy-duty commercial vehicle engines.

The engine braking technology is also well known. The engine is temporarily converted to a compressor, and in the conversion process the fuel is cut off, the exhaust valve is opened near the end of the compression stroke of the engine piston, thereby allowing the compressed gases (being air during braking) to be released. The energy absorbed by the compressed gas during the compression stroke cannot be returned to the engine piston at the subsequent expansion stroke, but is dissipated by the engine exhaust and cooling systems, which results in an effective engine braking and the slow-down of the vehicle.

There are different types of engine brakes. Typically, an engine braking operation is achieved by adding an auxiliary valve event for engine braking event into the normal engine valve event. Depending on how the auxiliary valve event is generated, an engine brake can be defined as:

1. Type I engine brake: the auxiliary valve event is introduced from a neighboring existing cam in the engine, which generates the so called Jake Brake;
2. Type II engine brake: the auxiliary valve event generates a lost motion type engine brake by altering existing cam profile;
3. Type III engine brake: the auxiliary valve event is produced from a dedicated cam for engine braking, which generates a dedicated brake valve event via a dedicated brake rocker arm;
4. Type IV engine brake: the auxiliary valve event is produced by modifying the existing valve lift of the engine, which normally generates a bleeder type engine brake; and
5. Type V engine brake: the auxiliary valve event is produced by using a dedicated valve train to generate a dedicated valve (the fifth valve) engine brake.

An example of engine brake devices in the prior art is disclosed by Cummins in U.S. Pat. No. 3,220,392. The engine brake system based on the patent has enjoyed a great commercial success. However, this engine brake system is a bolt-on accessory that fits above the engine. In order to mount the brake system, a spacer needs to be positioned between the cylinder and the valve cover. This arrangement may additionally increase height, weight, and cost to the engine.

Among these above five types of engine brakes, the third one, i.e. the dedicated cam or the dedicated rocker arm brake, has the best engine brake power. However, the existing dedicated rocker arm brake device cannot be applied to the engines with the valve bridge being parallel or almost parallel to the rocker arm.

SUMMARY OF THE INVENTION

An object of the present application is to provide a combined rocker arm device for producing an auxiliary engine valve event, so as to solve the technical problem in the prior art that the dedicated rocker arm brake system cannot be applied to the engines with the valve bridge being parallel to the rocker arm and to address the technical problems of increased engine height, weight and cost of a conventional engine brake device.

The combined rocker arm device for producing an auxiliary engine valve event of the present application is used to generate an auxiliary valve event of an engine, and the engine including a conventional valve actuator, the conventional valve actuator including a cam, a rocker arm shaft, a conventional rocker arm and a valve, wherein the combined rocker arm device includes an auxiliary actuator and a transition rocker arm, the auxiliary actuator acts on the transition rocker arm, and the transition rocker arm acts on the valve.

Further, the auxiliary engine valve event generated by the combined rocker arm device includes a valve event for engine braking.

Further, the auxiliary actuator of the combined rocker arm device includes an auxiliary rocker arm and an auxiliary cam, the auxiliary rocker arm and the conventional rocker arm are mounted on the rocker arm shaft side by side, one end of the auxiliary rocker arm is connected to the auxiliary cam, and the other end of the auxiliary rocker arm is placed adjacent to the transition rocker arm; the auxiliary rocker arm includes an actuation mechanism being provided with an actuation piston, the actuation mechanism includes an non-operating position and an operating position; in the non-operating position, the actuation piston of the actuation mechanism retracts, and the auxiliary rocker arm is separated from the transition rocker arm; and in the operating position, the actuation piston of the actuation mechanism extends, and the auxiliary rocker arm is connected to the transition rocker arm.

Further, a rocking axis of the transition rocker arm maintains relatively static during the auxiliary engine valve event.

Further, in the combined rocker arm device, the auxiliary rocker arm is a brake rocker arm, the auxiliary cam is a brake cam, the brake rocker arm includes a brake actuation mechanism being provided with a brake piston, the brake actuation mechanism includes an non-operating position and an operating position; in the non-operating position, the brake piston of the brake actuation mechanism retracts, and the brake rocker arm is separated from the transition rocker arm; and in the operating position, the brake piston of the brake actuation mechanism extends, and the brake rocker arm is connected to the transition rocker arm.

Further, in the combined rocker arm device, the transition rocker arm is rotationally mounted on the conventional rocker arm of the engine, and the transition rocker arm has a rocking shaft parallel to a rocker arm shaft of the conventional rocker arm.

Further, in the combined rocker arm device, the transition rocker arm shares the rocker arm shaft with the conventional rocker arm.

Further, the combined rocker arm device also includes an auxiliary spring located between the auxiliary rocker arm and the transition rocker arm.

Further, the transition rocker arm of the combined rocker arm device includes a rocking limiter.

The working principle of the present application is as follows, when the auxiliary engine valve event is needed, i.e. when the engine needs to be converted from the normal engine operation state to the engine braking state, the engine braking controller is turned on. The brake actuation mechanism in the brake rocker arm is converted from the non-operating position to the operating position, and the brake rocker arm is connected to the transition rocker arm. The motion from the auxiliary cam. i.e. the brake cam, is transmitted to the exhaust valve through the brake rocker arm and the transition rocker arm, thereby producing the auxiliary valve event for engine braking. When engine braking is not needed, the engine braking controller is turned off. The brake actuation mechanism retracts from the operating position to the non-operating position, and the brake rocker arm is separated from the transition rocker arm. The motion from the brake cam cannot be transmitted to the exhaust valve, and the engine is disengaged from the braking operation, and back to the normal operation state.

The present application has positive and obvious effects over the prior art. In the present application, less or no height, size and weight of the engine need to be increased, the application scope of the dedicated cam or the dedicated rocker arm brake device is enlarged, the engine braking performance is improved, and the affect of the engine braking operation on the engine ignition operation is reduced.

DETAILED DESCRIPTION OF THE EMBODIMENTS

Embodiment

Figure 1:
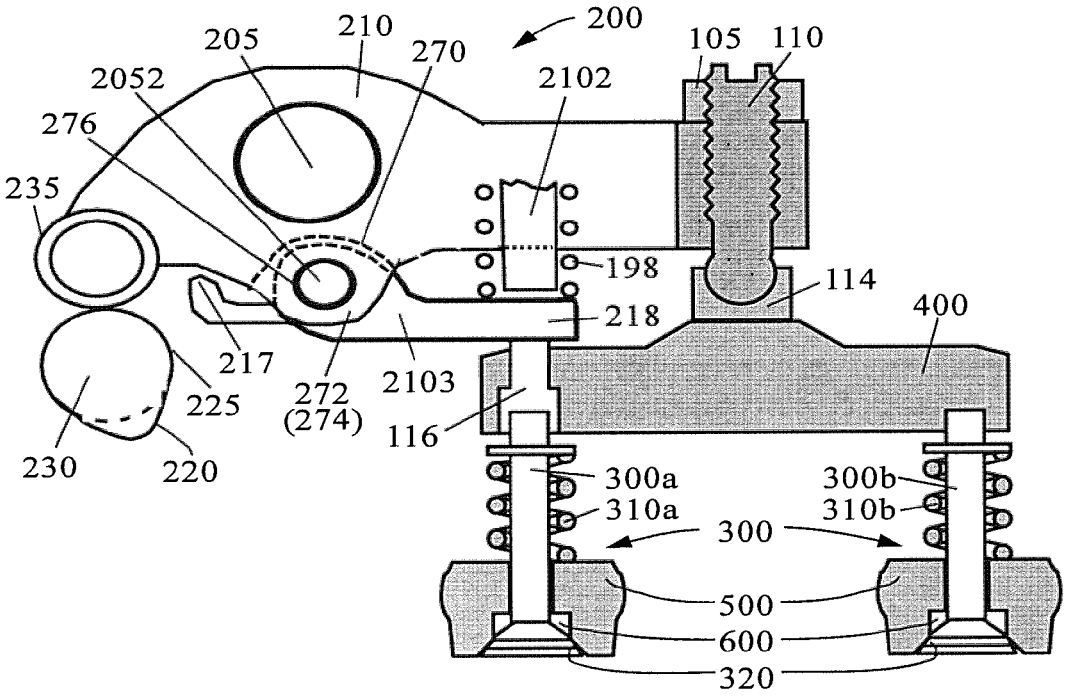
FIG. 1 is a schematic diagram illustrating the positional relationship among a transition rocker arm, a conventional rocker arm and a valve actuator of a combined rocker arm device according to an embodiment of the present application.

FIG. 1 is a schematic diagram illustrating the positional relationship among a transition rocker arm 2103, a conventional rocker arm 210 and a valve actuator 200 of a combined rocker arm device for an auxiliary engine valve event according to an embodiment of the present application. The auxiliary valve event generated by the combined rocker arm device of the present embodiment is an exhaust valve event for engine braking. The conventional engine exhaust valve event is generated by the engine exhaust valve actuator 200. The auxiliary exhaust valve event for engine braking is generated by an auxiliary actuator 2002. The auxiliary actuator 2002 includes an auxiliary rocker arm (shown as a brake rocker arm) 2102 and an auxiliary cam (shown as a brake cam 2302 shown in FIG. 5). It should be noted that the embodiment should not be regarded as limitation on the scope of the claims, but rather as exemplification of the present application.

The exhaust valve actuator 200 has many parts, including a cam 230, a cam follower 235, a conventional rocker arm 210, a valve bridge 400 and exhaust valves 300 (3001 and 3002). The exhaust valves 300 are biased on valve seats 320 in an engine cylinder block 500 by engine valve springs 310 (3101 and 3102) to prevent gases flowing between the engine cylinder and an exhaust manifold 600. The conventional rocker arm 210 is rotationally mounted on a rocker arm shaft 205 and transmits the motion from the cam 230 to the exhaust valves 300 for cyclic opening and closing of the exhaust valves 300. The exhaust valve actuator 200 also includes a valve lash adjusting screw 110 and an elephant foot pad 114. The valve lash adjusting screw 110 is fixed on the rocker arm 210 by a nut 105. On an inner base circle 225, the cam 230 has a conventional cam lobe 220 to generate the conventional valve lift profile (see 2202 in FIG. 6) for the conventional engine (ignition) operation.

Figure 2:
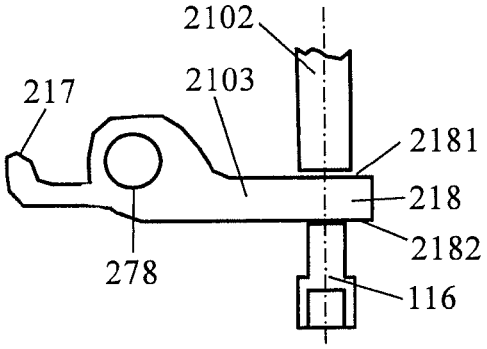
FIG. 2 is a side view of the transition rocker arm of the combined rocker arm device for an auxiliary engine valve event according to an embodiment of the present application.
Figure 3:
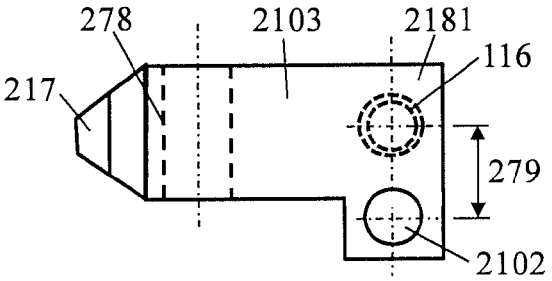
FIG. 3 is a top view of the transition rocker arm of the combined rocker arm device for an auxiliary engine valve event according to an embodiment of the present application.

As shown in FIGS. 1, 2 and 3, the transition rocker arm 2103 is rotationally mounted on the conventional rocker arm 210. A cutting groove 270 is provided at a lower portion of the conventional rocker arm 210, two ears 272 and 274 are respectively formed at two sides of the cutting groove 270, and a shaft hole 276 is formed in the two ears 272 and 274. A transition rocker arm shaft 2052 is disposed in a shaft hole 278 of the transition rocker arm 2103 (see FIG. 2 and FIG. 3), and then is installed in the shaft hole 276. The transition rocker arm shaft 2052 and the rocker arm shaft 205 are parallel to each other. Therefore, the transition rocker arm 2103 can rock with respect to the conventional rocker arm 210 with the rocking range controlled by a rocking limiter. The rocking limiter includes a limiting end 217 of the transition rocker arm 2103. The rocking range of the transition rocker arm 2103 is controlled by controlling a distance between the limiting end 217 and the conventional rocker arm 210. The rocking range of the transition rocker arm 2103 is determined by a rocking range of the auxiliary rocker arm (i.e. the brake rocker arm) 2102 (the brake rocker arm 2102 is described more specifically in FIG. 4 and FIG. 5) due to the reason that the transition rocker arm 2103 is located under the brake rocker arm 2102 and is actuated by the brake rocker arm 2102. The transition rocker arm 2103 is also located above a brake pushrod 116 (the exhaust valve 3001). The transition rocker arm 2103 may not need the brake pushrod 116, but directly act on the valve bridge 400 or the exhaust valve 3001. The auxiliary spring or brake spring 198 in FIG. 1 is used to prevent the transition rocker arm 2103 and the brake rocker arm 2102 from not-following or colliding.

FIGS. 2 and 3 are the side view and top view of the transition rocker arm 2103 respectively, which are used to further describe the positional relationship among the transition rocker arm 2103, the brake rocker arm 2102 and the brake pushrod 116 (or the exhaust valve 3001). The brake rocker arm 2102 acts on an upper surface 2181 on an end 218, near the exhaust valve, of the transition rocker arm 2103, while a lower surface 2182 of the transition rocker arm 2103 acts on the brake push rod 116 (or the exhaust valve 3001). A distance between the two acting points is shown by the reference numeral 279 (see FIG. 3).

Figure 4:
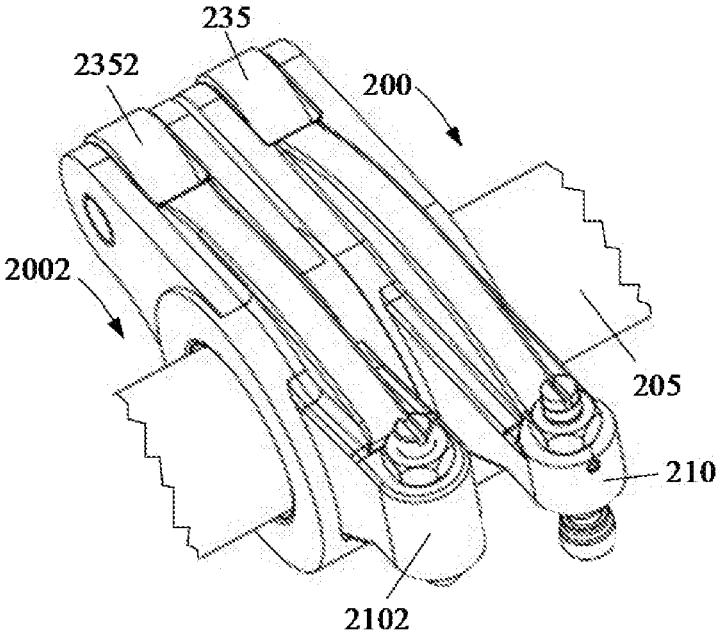
FIG. 4 is a schematic diagram illustrating the positional relationship between a brake rocker arm and the conventional rocker arm of the combined rocker arm device for an auxiliary engine valve event according to an embodiment of the present application.

FIG. 4 is a schematic diagram illustrating the positional relationship between the auxiliary rocker arm (i.e. the brake rocker arm) 2102 and the conventional rocker arm 210 of the combined rocker device according to the embodiment of the present application, wherein the brake rocker arm 2102 and the conventional rocker arm 210 are installed on the rocker arm shaft 205 side by side.

Figure 5:
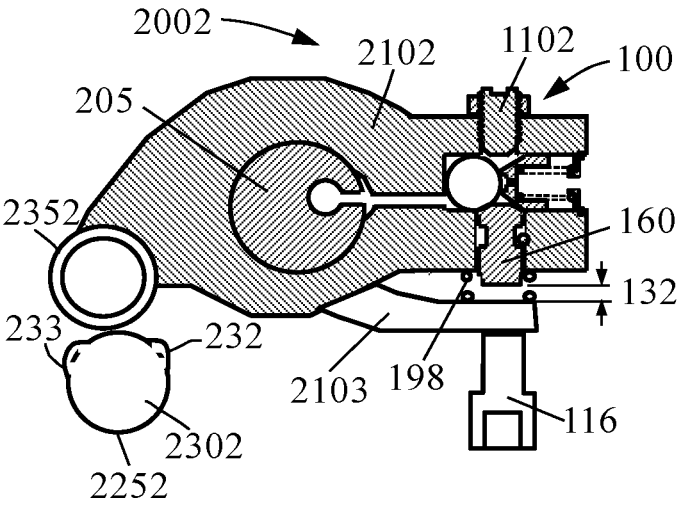
FIG. 5 is a schematic diagram illustrating the brake rocker arm and its relative position with the combined rocker arm device for an auxiliary engine valve event according to an embodiment of the present application.

FIG. 5 is a schematic diagram illustrating the brake rocker arm 2102 and its relative position with the combined rocker arm device according to the embodiment of the present application. The brake rocker arm 2102 includes a brake actuation mechanism 100. The brake actuation mechanism 100 includes an actuation piston (a brake piston) 160 which is moveable between a non-operating position and an operating position. When in the non-operating position as shown in FIG. 5, i.e. when engine braking is not needed, the brake piston 160 of the brake actuation mechanism 100 retracts, and the brake rocker arm 2102 is separated from the transition rocker arm 2103 thereby forming a gap 132 between the brake rocker arm 2102 and the transition rocker arm 2103. The gap 132 is adjustable by an adjusting screw 1102 of a brake valve lash adjusting mechanism, such that the motion generated by the auxiliary cam lobes (the brake cam lobes) 232 and 233 on the inner base circle 2252 of the brake cam 2302 cannot be transmitted to the exhaust valve 3001.

When the auxiliary valve event, i.e. the engine braking, is needed, the engine brake controller (not shown) is turned on to supply engine oil, and the engine oil acts on the brake actuation mechanism 100, such that the brake piston 160 is extended from the retracted non-operating position (as shown in FIG. 5) to the operating position, thereby eliminating the gap 132 between the brake rocker arm 2102 and the transition rocker arm 2103, that is the brake rocker arm 2102 is connected to the transition rocker arm 2103. Through the cam follower 2352, the brake rocker arm 2102 and the brake actuation mechanism 100 thereof, the transition rocker arm 2103 and the brake pushrod 116, the motion generated by the auxiliary cam lobes (the brake cam lobes) 232 and 233 on the inner base circle 2252 of the brake cam 2302 is transmitted to the exhaust valve 3001, thereby generating the auxiliary engine valve event for engine braking.

The auxiliary spring or the brake spring 198 in FIG. 1 is shown again in FIG. 5. The auxiliary spring 198 is located between the brake rocker arm 2102 and the transition rocker arm 2103 to separate the above two components. An upward force of the spring 198 biases the brake rocker arm 2102 on the brake cam 2302. A downward force of the spring 198 biases the transition rocker arm 2103 on the brake pushrod 116. When the brake push rod 116 is pushed downward along with the valve bridge 400 and the exhaust valve 300 by the exhaust valve actuator 200 (see FIG. 1), the downward force of the spring 198 biases the transition rocker arm 2103 on the conventional rocker arm 210 (see FIG. 1). If the deformation of the spring 198 is large enough, the transition rocker arm 2103 does not need to have the rocking limiter, that is, the limiting end 217 is not needed. In this way, the transition rocker arm 2103 becomes a "semi-rocker arm" and is always in contact with the brake pushrod 116 (or the exhaust valve 3001). It should be noted that the force of the auxiliary spring or the brake spring 198 is much smaller than the preload force of the engine valve spring 3101.

Figure 6:
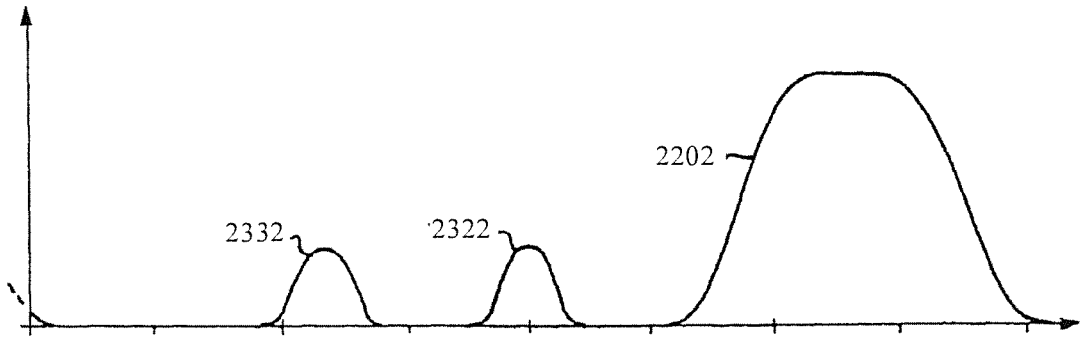
FIG. 6 is a schematic diagram illustrating the conventional valve lift profile and the auxiliary valve lift profile (engine brake valve lift) for the combined rocker arm device for an auxiliary engine valve event according to an embodiment of the present application.

FIG. 6 is a schematic diagram illustrating the conventional valve lift profile 2202 and the auxiliary valve lift profiles (the engine brake valve lift) 2322 and 2332 for the combined rocker arm device according to the embodiment of the present application. The conventional valve lift profile 2202 generated by the valve actuator 200 corresponds to the conventional cam lobe 220 on the inner base circle 225 of cam 230 as shown in FIG. 1. The auxiliary valve lift (the engine brake valve lift) profiles 2322 and 2332 generated by the brake rocker arm 2102 and the transition rocker arm 2103 correspond to the auxiliary cam lobes (the brake cam lobes) 232 and 233 on the inner base circle 2252 of the brake cam 2302 as in FIG. 5.

In FIG. 6, the conventional valve lift profile 2202 is separated from the auxiliary valve lift profiles 2322 and 2332, thus the actuation timing of the conventional rocker arm 210 is staggered from that of the brake rocker arm 2102. When the brake rocker arm 2102 actuates the transition rocker arm 2103, the conventional rocker arm 210 is stationary. Therefore, the rocking shaft 2052 (as shown in FIG. 1) of the transition rocker arm 2103 mounted on the conventional rocker arm 210 is also stationary. In other words, when the auxiliary cam lobes 232 and 233 of the cam 2302 (as shown in FIG. 5) actuates the brake rocker arm 2102, the transition rocker arm 2103 and the valve 3001 to produce the auxiliary valve lift profiles 2322 and 2332, a rocking axis of the transition rocker arm 2103 is stationary.

Therefore, the rocking shaft 2052 of the transition rocker arm 2103 can also be installed on other portions of the engine, for example, sharing the rocker shaft 205 with the conventional rocker arm 210, as long as the rocking axis of the transition rocker arm 2103 can remain relatively static when the auxiliary rocker arm produces the auxiliary valve event. In addition, the actuation mechanism on the auxiliary rocker arm 2102 can also be transferred onto the transition rocker arm 2103.

While the above description contains many specific embodiments, these embodiments should not be regarded as limitations on the scope of the present application, but rather as specific exemplifications of the present application. Many other variations are likely to be derived from the specific embodiments. For example, the combined rocker arm device described herein can be used to produce the auxiliary engine valve event not only for engine braking, but also for exhaust gas recirculation and other auxiliary engine valve events.

In addition, the combined rocker arm device described herein can be used not only for overhead cam engines, but also for push rod/tubular engines, and can be used not only for exhaust valve actuation, but also for intake valve actuation.

Also, the auxiliary actuator 2002 described herein can include not only the brake rocker arm and the brake cam, but also other actuation mechanisms, including mechanical, hydraulic, electromagnetic, or a combined mechanism.

Therefore, the scope of the present application should not be defined by the above-mentioned specific examples, but by the appended claims and their legal equivalents.

What is claimed is:

1. A combined rocker arm device for producing an auxiliary valve event of an engine, the engine comprising a conventional valve actuator for producing a conventional valve event, the conventional valve actuator comprising a cam, a rocker arm shaft, a conventional rocker arm and a valve, wherein the auxiliary valve event is different from the conventional valve event, and the combined rocker arm device comprises an auxiliary actuator that is used only for producing the auxiliary valve event, and a transition rocker arm, wherein during the auxiliary valve event, the auxiliary actuator acts on the transition rocker arm, and the transition rocker arm acts on the valve.

2. The combined rocker arm device for producing an auxiliary engine valve event according to claim 1, wherein the auxiliary engine valve event comprises a valve event for engine braking.

3. The combined rocker arm device for producing an auxiliary engine valve event according to claim 1, wherein the auxiliary actuator comprises an auxiliary rocker arm and an auxiliary cam, the auxiliary rocker arm and the conventional rocker arm are mounted on the rocker arm shaft side by side, one end of the auxiliary rocker arm is connected to the auxiliary cam, and the other end of the auxiliary rocker arm is placed adjacent to the transition rocker arm; the auxiliary rocker arm comprises an actuation mechanism being provided with an actuation piston, the actuation mechanism comprises an non-operating position and an operating position; in the non-operating position, the actuation piston of the actuation mechanism retracts, and the auxiliary rocker arm is separated from the transition rocker arm; and in the operating position, the actuation piston of the actuation mechanism extends, and the auxiliary rocker arm is connected to the transition rocker arm.

4. The combined rocker arm device for producing an auxiliary engine valve event according to claim 3, wherein the auxiliary rocker arm is a brake rocker arm, the auxiliary cam is a brake cam, the brake rocker arm comprises a brake actuation mechanism being provided with a brake piston, the brake actuation mechanism comprises an non-operating position and an operating position; in the non-operating position, the brake piston of the brake actuation mechanism retracts, and the brake rocker arm is separated from the transition rocker arm; and in the operating position, the brake piston of the brake actuation mechanism extends, and the brake rocker arm is connected to the transition rocker arm.

5. The combined rocker arm device for producing an auxiliary engine valve event according to claim 1, wherein a rocking axis of the transition rocker arm maintains relatively static during the auxiliary engine valve event.

6. The combined rocker arm device for producing an auxiliary engine valve event according to claim 1, wherein the transition rocker arm is rotationally mounted on the conventional rocker arm, and the transition rocker arm has a rocking shaft parallel to a rocker arm shaft of the conventional rocker arm.

7. The combined rocker arm device for producing an auxiliary engine valve event according to claim 1, wherein the transition rocker arm shares the rocker arm shaft with the conventional rocker arm.

8. The combined rocker arm device for producing an auxiliary engine valve event according to claim 1, further comprising an auxiliary spring located between the auxiliary rocker arm and the transition rocker arm.

9. The combined rocker arm device for producing an auxiliary engine valve event according to claim 1, wherein the auxiliary actuator has an operating condition during the auxiliary valve event and a non-operating condition during the conventional valve event, and wherein only when the auxiliary actuator is in the operating condition, the auxiliary actuator acts on the transition rocker arm, and the transition rocker arm acts on the valve.

10. The combined rocker arm device for producing an auxiliary engine valve event according to claim 1, wherein during the auxiliary valve event, the movement of the auxiliary actuator is transmitted to the valve to open and close the valve to generate the auxiliary valve event, and wherein during the conventional valve event, the movement of the auxiliary actuator is not transmitted to the valve to open and close the valve to generate the auxiliary valve event.

11. A combined rocker arm device for producing an auxiliary valve event of an engine, the engine comprising a conventional valve actuator, the conventional valve actuator comprising a cam, a rocker arm shaft, a conventional rocker arm and a valve, wherein the combined rocker arm device comprises:

an auxiliary actuator, and a transition rocker arm, wherein the auxiliary actuator acts on the transition rocker arm, and the transition rocker arm acts on the valve, and wherein the transition rocker arm comprises a rocking limiter.

12. A combined rocker arm device for producing an auxiliary valve event of an engine, the engine comprising a conventional valve actuator, the conventional valve actuator comprising a cam, a rocker arm shaft, a conventional rocker arm and a valve, wherein the combined rocker arm device comprises:

an auxiliary actuator, a transition rocker arm, wherein the auxiliary actuator acts on the transition rocker arm, and the transition rocker arm acts on the valve, and wherein the auxiliary actuator comprises an auxiliary rocker arm and an auxiliary cam, the auxiliary rocker arm and the conventional rocker arm are mounted on the rocker arm shaft side by side, one end of the auxiliary rocker arm is connected to the auxiliary cam, and the other end of the auxiliary rocker arm is placed adjacent to the transition rocker arm; the auxiliary rocker arm comprises an actuation mechanism being provided with an actuation piston, the actuation mechanism comprises an non-operating position and an operating position; in the non-operating position, the actuation piston of the actuation mechanism retracts, and the auxiliary rocker arm is separated from the transition rocker arm; and in the operating position, the actuation piston of the actuation mechanism extends, and the auxiliary rocker arm is connected to the transition rocker arm, and an auxiliary spring located between the auxiliary rocker arm and the transition rocker arm.

* * * * *